US010972843B2

(12) United States Patent
Yoshino

(10) Patent No.: US 10,972,843 B2
(45) Date of Patent: Apr. 6, 2021

(54) LIGHT GUIDE BODY FOR MICROPHONE, AND MICROPHONE

(71) Applicant: Audio-Technica Corporation, Tokyo (JP)

(72) Inventor: Satoshi Yoshino, Tokyo (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 0 days.

(21) Appl. No.: 16/411,560

(22) Filed: May 14, 2019

(65) Prior Publication Data

US 2019/0356987 A1 Nov. 21, 2019

(30) Foreign Application Priority Data

May 17, 2018 (JP) ..... JP2018-095745

(51) Int. Cl.
*H04R 19/04* (2006.01)
*F21V 33/00* (2006.01)
*H04R 1/08* (2006.01)

(52) U.S. Cl.
CPC ..... *H04R 19/04* (2013.01); *F21V 33/0056* (2013.01); *H04R 1/08* (2013.01)

(58) Field of Classification Search
CPC .. F21V 33/0052; F21V 33/0056; F21V 33/00; H04R 19/04; H04R 1/08
See application file for complete search history.

(56) References Cited

U.S. PATENT DOCUMENTS

2013/0335966 A1* 12/2013 Yokota ..... G02B 6/0033 362/235
2015/0092975 A1* 4/2015 Akino ..... F21V 33/0056 381/355
2015/0304754 A1* 10/2015 Akino ..... H04R 1/028 381/359
2016/0154171 A1* 6/2016 Kato ..... G02B 6/0068 362/606
2019/0041050 A1* 2/2019 Cairns ..... G02B 6/0085
2019/0301727 A1* 10/2019 Sieczkowski ..... G02B 6/0095

FOREIGN PATENT DOCUMENTS

JP 2015-119271 A 6/2015
JP 2017-28603 A 2/2017

* cited by examiner

*Primary Examiner* — William N Harris
(74) *Attorney, Agent, or Firm* — W&C IP

(57) ABSTRACT

The present invention provides a light guide body for a microphone that radiates light from a small number of light sources toward a surrounding of a microphone with a uniform quantity of light. The light guide body for the microphone that guides light from one or more light sources which emit light in accordance with operating a state of a microphone unit of the microphone. The light guide body has a plate shape and comprises one or more incident surfaces on which light from the light source is incident, and one or more grooves, each of which includes a reflecting surface that reflects light incident on the incident surface.

18 Claims, 11 Drawing Sheets

LIGHT GUIDE BODY FOR MICROPHONE, AND MICROPHONE

TECHNICAL FIELD

The present invention relates to a light guide body for a microphone, and a microphone.

BACKGROUND ART

As microphones to be used in a place such as a conference hall or a classroom, microphones including a light-emitting part (light emitting diode (LED)) have been used (for example, see Japanese Unexamined Patent Publication No. 2015-119271). The light-emitting part indicates an operating state of the microphone (states of the microphone such as on/off of its power) to a third party such as a participant of a conference or an operator of the microphone.

A microphone disclosed in Japanese Unexamined Patent Publication No. 2015-119271 radiates light from an LED to a wide range through a light guide member. Thus, this microphone can indicate an operating state of a microphone unit to a surrounding of the microphone.

The microphone disclosed in Japanese Unexamined Patent Publication No. 2015-119271 includes one microphone unit, two LEDs, and a C-shaped light guide member. Light from the LEDs is incident into the light guide member from incident parts that are disposed on both ends of the light guide member, being guided within the light guide member. The thickness of the light guide member is configured to be gradually thinner from a part closest to the incident parts toward a part farthest to the incident parts in the light guide member. Thus, light within the light guide member is converged as light becomes farther from the incident parts, and is radiated with a uniform quantity of light from the entire light guide member. As a result, the light guide member indicates the operating state of the microphone unit to the surrounding of the microphone.

In this manner, the technique disclosed in Japanese Unexamined Patent Publication No. 2015-119271 enables light from a small number of LED to radiate with a uniform quantity of light (intensity) from the entire light guide member. Thus, this technique exerts the same effect even in a microphone that has limitations in the maximum current value to be applied to a microphone unit and the number of LED such as a condenser-type microphone unit that is driven with phantom power.

Alternatively, as microphones that collect sounds of a conversation among a plurality of speakers by varying directivity, microphones including a plurality of microphone units have been used (for example, see Japanese Unexamined Patent Publication No. 2017-28603).

SUMMARY OF INVENTION

Technical Problem

A housing of a microphone disclosed in Japanese Unexamined Patent Publication No. 2017-28603 accommodates a plurality of microphone units. Thus, this housing is larger than a housing of the microphone disclosed in Japanese Unexamined Patent Publication No. 2015-119271, which accommodates one microphone unit. As a result, when the technique disclosed in Japanese Unexamined Patent Publication No. 2015-119271 is applied to a microphone including a plurality of microphone units, a length of the light guide member becomes longer. That is, light from the LED is guided for longer distance. However, a quantity of light of light from the LED is attenuated due to, for example, an influence of internal loss and radiation from the light guide member, in accordance with the distance that light is guided within the light guide member. Thus, in the technique disclosed in Japanese Unexamined Patent Publication No. 2015-119271, the length of the light guide member enabling light to radiate with a uniform quantity of light is limited. Accordingly, even if the technique disclosed in Japanese Unexamined Patent Publication No. 2015-119271 is applied to a microphone including a plurality of microphone units, light from the LED is not radiated with a uniform quantity of light from the entire light guide part.

An object of the present invention is to radiate light from a small number of light sources with a uniform quantity of light toward a surrounding of a microphone, regardless of a size of a housing that accommodates a microphone unit.

Solution to Problem

The present invention is a light guide body for a microphone that guides light from a light source emitting light in accordance with an operating state of a microphone unit of the microphone, the light guide body having a plate shape, including: one or more incident surfaces on which light from the light source is incident; and one or more grooves, each of which includes a reflecting surface that reflects light incident on the incident surface.

Advantageous Effects of Invention

According to the present invention, light from a small number of light sources can be radiated with a uniform quantity of light toward a surrounding of a microphone, regardless of a size of a housing that accommodates a microphone unit.

DESCRIPTION OF EMBODIMENTS

Embodiments of a microphone and a light guide body for a microphone (hereinafter, referred to as "present light guide body") according to the present invention will now be described referring to the attached drawings.

Microphone

Configuration of Microphone

Figure 1:
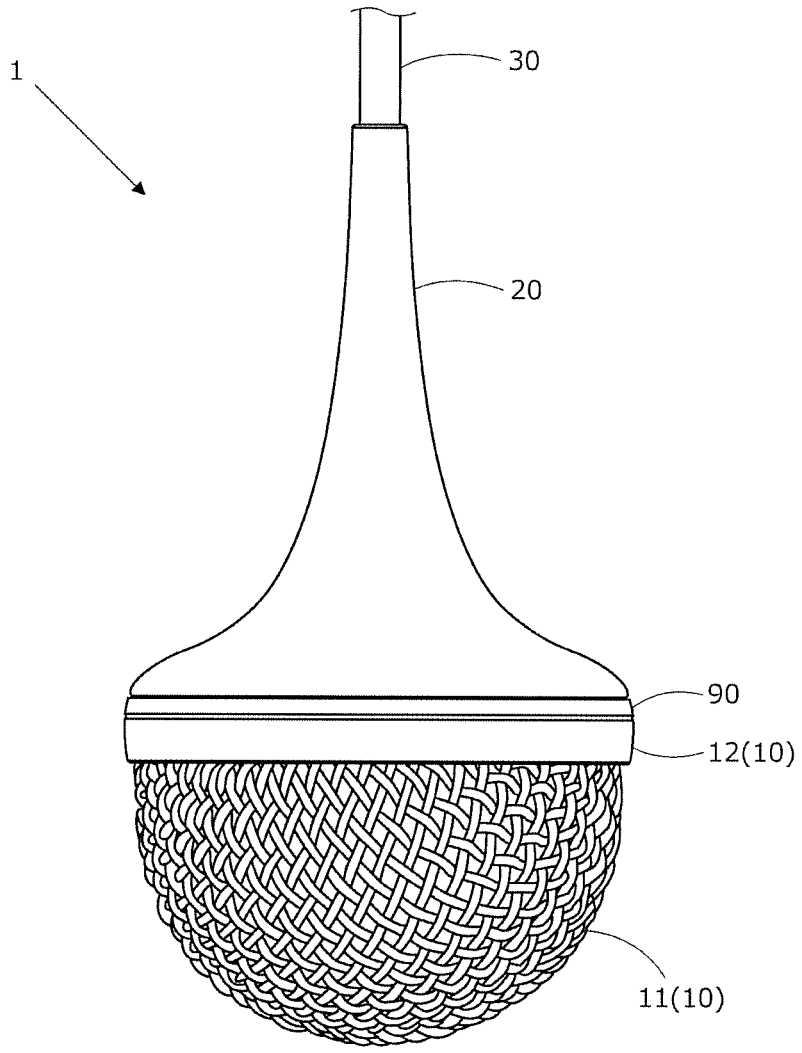
FIG. 1 is an external view illustrating an embodiment of a microphone according to the present invention.

FIG. 1 is an external view illustrating an embodiment of the microphone according to the present invention.

A microphone 1 collects sound waves from a sound source (not illustrated), and converts the sound waves into electric signals. The microphone 1 is, for example, a hanging microphone. The hanging microphone is, in use, hung down from a ceiling of a conference room or stage, for example.

In the following descriptions, the side of the ceiling (the upper side of the page of FIG. 1) from which the microphone 1 is hung down will be referred to as "upside", and the opposite side (the lower side of the page of FIG. 1) will be referred to as "downside".

Figure 2:
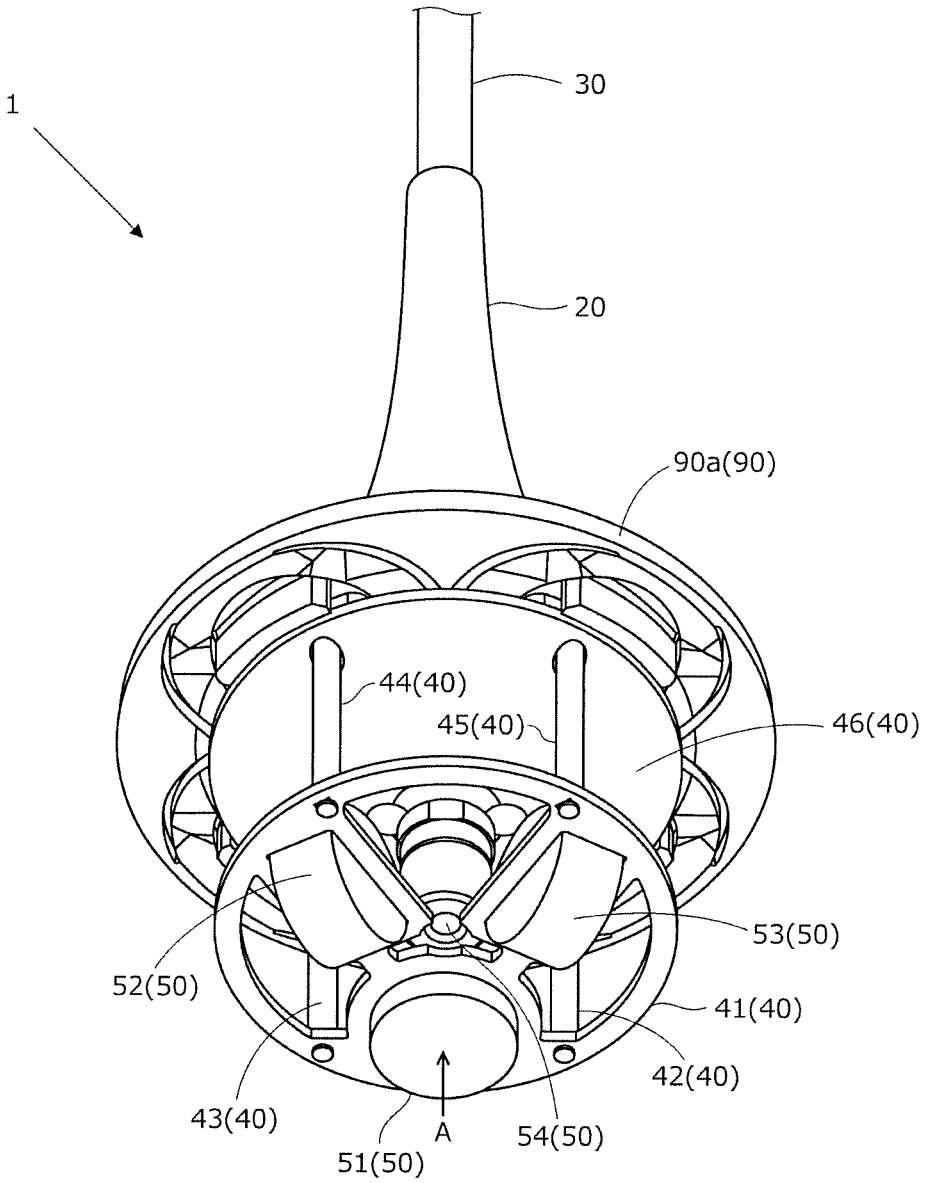
FIG. 2 is a perspective view of the microphone in FIG. 1, in a state in which a head case provided in the microphone is removed.

FIG. 2 is a perspective view of the microphone 1.

Figure 3:
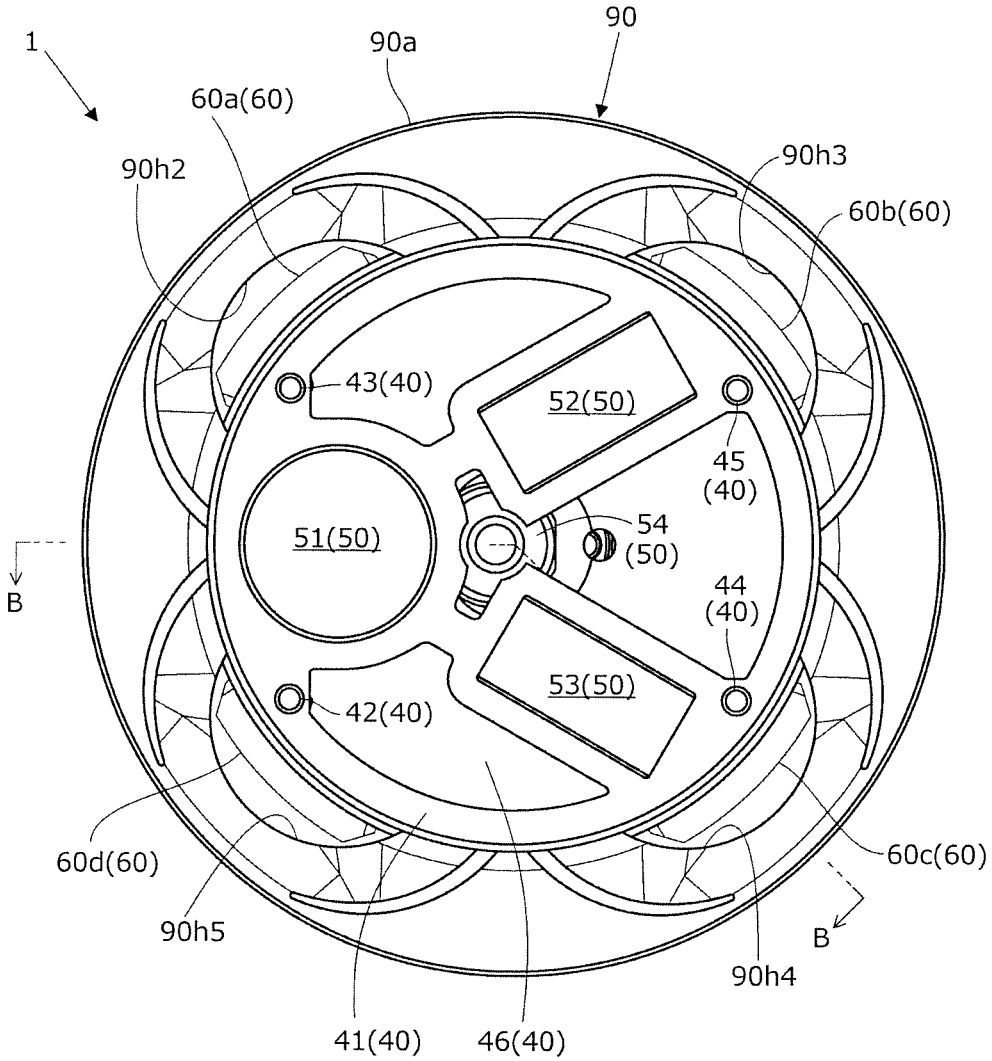
FIG. 3 is a view of the microphone viewed along an arrow A in FIG. 2.

FIG. 3 is a view of the microphone 1 viewed along the arrow A in FIG. 2.

Figure 4:
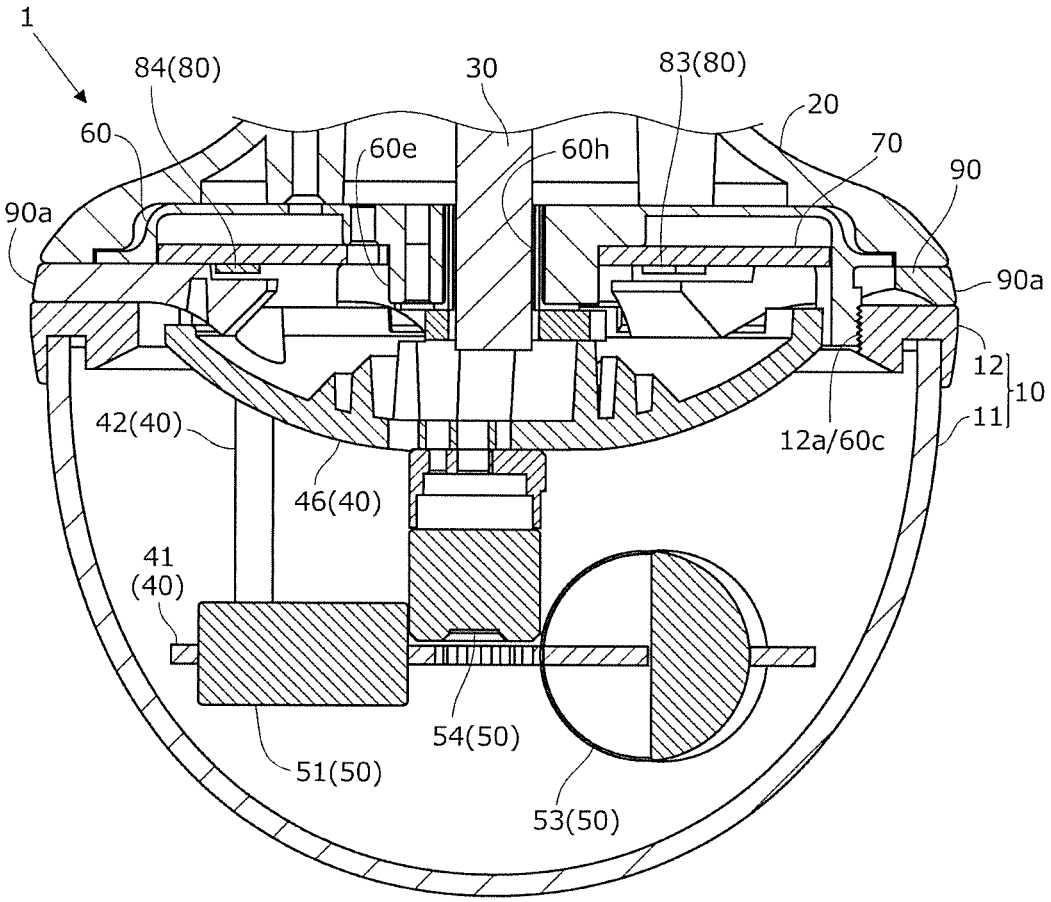
FIG. 4 is a cross-sectional view of the microphone in FIG. 1 taken along line B-B in FIG. 3.

FIG. 4 is a cross-sectional view of the microphone 1 taken along line B-B in FIG. 3.

FIG. 2 is a perspective view of the microphone 1 in a state in which a head case 10, which will be described below, is removed, viewed diagonally downside. FIG. 3 is a bottom view of the microphone 1 viewed from the downside.

The microphone 1 includes the head case 10, a first housing 20, a second housing 30, a unit support member 40, a unit part 50, a support member 60, a circuit board 70, a light-emitting part 80, and a light guide body 90.

The head case 10 protects the unit part 50. The head case 10 includes a case part 11 and a fixing part 12. The case part 11 protects the unit part 50. The case part 11 is made of, for example, a steel outer grille and a metal mesh (not illustrated). The case part 11 is in a bowl shape having an opening at its upper end. The fixing part 12 fixes the case part 11 to the support member 60. The fixing part 12 is in a ring shape. The fixing part 12 is attached to the upper end (opening end) of the case part 11. An inner peripheral surface of the fixing part 12 forms a female screw part 12*a* in which a female screw surface is formed.

The first housing 20 accommodates the support member 60, the circuit board 70, and the light-emitting part 80. The first housing 20 is made of, for example, a synthetic resin. The first housing 20 is in a substantially conical cylindrical shape. That is, the first housing 20 has openings at its upper and lower ends, and a diameter that rapidly expands from the upper end side toward the lower end side.

The second housing 30 accommodates a cable (not illustrated) for transmitting, for example, a voice signal from the unit part 50, or power supplied to the unit part 50 or to the light-emitting part 80. The second housing 30 is made of, for example, a synthetic resin. The second housing 30 is in an elongated cylindrical shape.

The unit support member 40 supports the unit part 50. The unit part 50 includes a lattice-shaped frame 41, four supports 42, 43, 44 and 45, and an umbrella-shaped protective cover 46. The supports 42-45 are attached to outer edge parts on an undersurface of the protective cover 46. The frame 41 is attached to lower ends of the supports 42-45 so as to oppose the protective cover 46.

The unit part 50 collects sound waves from a sound source, and converts the sound waves into electric signals. The unit part 50 includes four microphone units (hereinafter, referred to as "units") 51, 52, 53 and 54. The unit 51 is, for example, an omnidirectional condenser-type microphone unit. The units 52-54 are, for example, bidirectional condenser-type microphone units. The unit 51 is fitted into the frame 41 such that a sound collecting axis (directional axis) is parallel to the vertical direction. A collecting surface faces the downward direction. The units 52 and 53 are fitted into the frame 41 such that an angle formed by each of their sound collecting axes (directional axes) becomes 120°. The unit 54 is attached at substantially the center to the undersurface of the protective cover 46 such that its sound collecting axis (directional axis) is parallel to the vertical direction.

The type of the unit is not limited to the condenser-type. That is, for example, the unit may be a dynamic-type microphone unit.

The support member 60 supports the head case 10, the second housing 30, and the circuit board 70. The support member 60 is made of metal. The support member 60 is in a circular dish shape that is opened to the downside. The support member 60 is accommodated in the first housing 20, and is fixed to the first housing 20 so as to cover the opening on the lower end side of the first housing 20. The support member 60 includes four male screw parts 60*a*, 60*b*, 60*c* and 60*d*, a support part 60*e*, and a support hole 60*h*.

The male screw parts 60*a*-60*d* are fitted into the female screw part 12*a* of the head case 10. As a result, the head case 10 is fixed to the support member 60. The male screw parts 60*a*-60*d* are in curved plate shapes, and project from the opening end of the support member 60 to the downside. Outer peripheral surfaces of the male screw parts 60*a*-60*d* are male screw surfaces corresponding to the female screw surface of the female screw part 12*a*. The male screw parts 60*a*-60*d* are disposed at intervals of an equal angle (90° in the present embodiment) in a circumferential direction of the support member 60. The support part 60*e* and the support hole 60*h* support the lower end of the second housing 30, and the unit support member 40. The support part 60*e* is in a columnar shape projecting from the center of the support member 60 to the downside. The support hole 60*h* is disposed at the center of the support part 60*e*.

On the circuit board 70, the light-emitting part 80, an electric circuit required for processing a voice signal from the microphone 1, and other components are implemented. The circuit board 70 is in a disc shape having a circular hole at the center. The circuit board 70 is accommodated in the support member 60, and is fixed to the support member 60.

The light-emitting part 80 emits light in accordance with operating states of the four units 51-54. The light-emitting part 80 is provided with four light emitting diodes (LEDs) 81, 82, 83 and 84 (also see FIG. 6) that emit light of multiple colors. The respective LEDs 81-84 are light sources in the present invention. The respective LEDs 81-84 are implemented on the circuit board 70 and are arranged near the outer edge of the undersurface of the circuit board 70, at intervals of an equal angle (90° in the present embodiment) in a circumferential direction of the circuit board 70.

The "operating states of the units 51-54" include, for example, a state which the microphone 1 is powered on and the units 51-54 can collect sound waves, a state which the microphone 1 is powered on and the units 51-54 are unable to collect sound waves, and a state which the microphone 1 is powered off (a state which the units 51-54 are unable to collect sound waves). The respective LEDs 81-84 are, for example, lighted in "green" when the microphone 1 is powered on and the units 51-54 can collect sound waves, lighted in "red" when the microphone 1 is powered on and the units 51-54 are unable to collect sound waves, and turned off when the microphone 1 is powered off.

The light guide body 90 guides light from the light-emitting part 80 (performs light guiding), and radiates light from an outer peripheral surface 90*a*, which will be described below, to the exterior. In other words, the outer peripheral surface 90*a* is a radiation surface from which the light guided by the light guide body 90 is radiated. The light guide body 90 is the present light guide body. The configuration of the light guide body 90 will be described below.

The lower end part of the second housing 30 is inserted into the first housing 20 from the opening on the lower end side of the first housing 20, and is fitted into the support hole 60*h* of the support member 60. The unit support member 40 is fixed to the support part 60*e* of the support member 60. The light guide body 90 is disposed on the lower end surface (opening surface on the lower end side) of the first housing 20. The male screw parts 60*a*-60*d* of the support member 60 are screwed into the female screw part 12*a* of the head case 10. As a result, the unit support member 40 and the unit part 50 are accommodated in the head case 10. The outer peripheral edge part of the light guide body 90 is held between the head case 10 and the first housing 20. The outer peripheral surface 90*a* of the light guide body 90 is then exposed to the exterior of each of the head case 10 and the first housing 20. In this manner, the head case 10 and the first housing 20 form the case of the present invention, which accommodates the unit part 50.

Configuration of Light Guide Body for a Microphone

Figure 5:
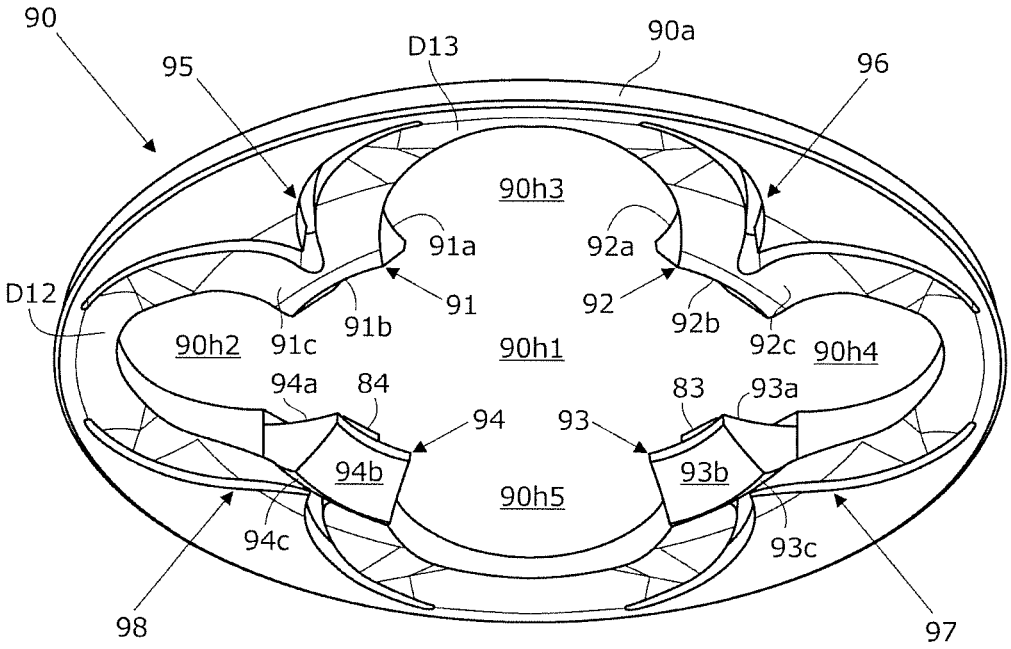
FIG. 5 is a perspective view of an exemplary light guide body for a microphone according to the present invention.

FIG. 5 is a perspective view illustrating an embodiment of the present light guide body.

This figure also illustrates the LEDs 83 and 84.

The light guide body 90 is in a substantially plate form having a circular shape. The light guide body 90 is made of, for example, a translucent resin such as polymethyl methacrylate (PMMA). The light guide body 90 includes a central hole 90*h*1, four sub-holes 90*h*2, 90*h*3, 90*h*4 and 90*h*5, four projecting parts 91, 92, 93 and 94, and four grooves 95, 96, 97 and 98.

Figure 6:
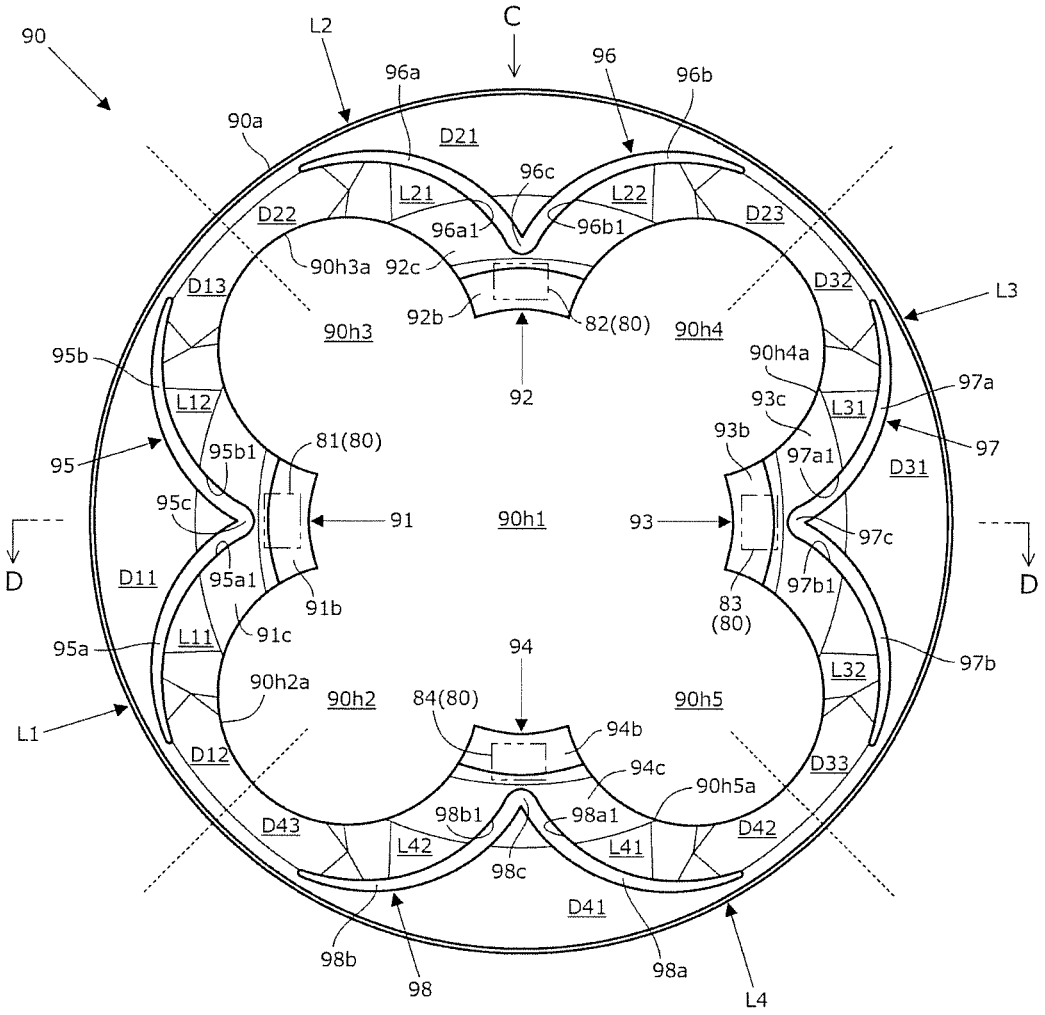
FIG. 6 is a bottom view of the light guide body in FIG. 5.

FIG. 6 is a bottom view of the light guide body 90.

This figure also illustrates the LEDs 81-84, with two-dot chain lines.

The central hole 90*h*1 separates incident surfaces 91*a*-94*a* (which will be described below) such that light from the respective LEDs 81-84 enters only the incident surfaces 91*a*-94*a* corresponding to the respective LEDs 81-84. The central hole 90*h*1 is in a circular shape. The central hole 90*h*1 is disposed at the center of the light guide body 90 in a bottom view (or in a plan view). The incident surfaces 91*a*-94*a* will be described below.

The respective sub-holes 90*h*2-90*h*5 form parts of respective light guiding paths L11-L42, which will be described below, together with the grooves 95-98. The respective sub-holes 90*h*2-90*h*5 are in circular shapes having a smaller diameter than that of the central hole 90*h*1. The respective sub-holes 90*h*2-90*h*5 are disposed in the surrounding of the central hole 90*h*1 at intervals of an equal angle in a circumferential direction of the central hole 90*h*1. The respective sub-holes 90*h*2-90*h*5 communicate with the central hole 90*h*1, and constitute one hole together with the central hole 90*h*1. The respective sub-holes 90*h*2-90*h*5 form respective inner peripheral surfaces 90*h*2*a*-90*h*5*a* of the light guide body 90, which will be described below.

The respective projecting parts 91-94 guide light from the corresponding LEDs 81-84 to the corresponding grooves 95-98. The respective projecting parts 91-94 are convex toward the central hole 90*h*1, and are mountain-shaped in a bottom view. The respective projecting parts 91-94 are disposed in the surrounding of the central hole 90*h*1 at intervals of an equal angle (90° in the present embodiment) in the circumferential direction of the central hole 90*h*1.

Figure 7:
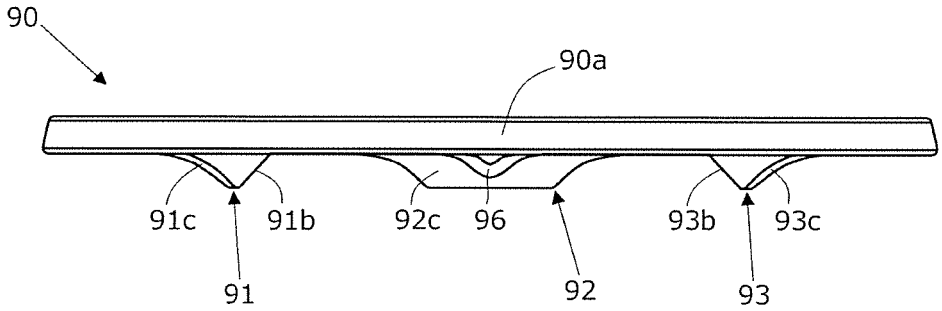
FIG. 7 is a view of the light guide body viewed along an arrow C in FIG. 6.

FIG. 7 is a view of the light guide body 90 viewed along the arrow C in FIG. 6

Figure 8:
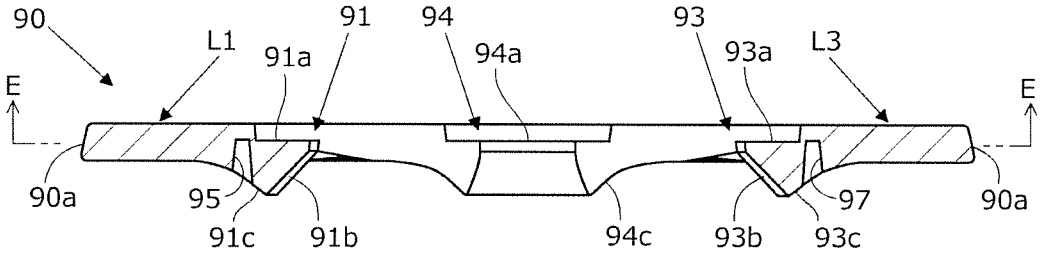
FIG. 8 is a cross-sectional view of the light guide body taken along line D-D in FIG. 6.

FIG. 8 is a cross-sectional view of the light guide body 90 taken along line D-D in FIG. 6.

Figure 9:
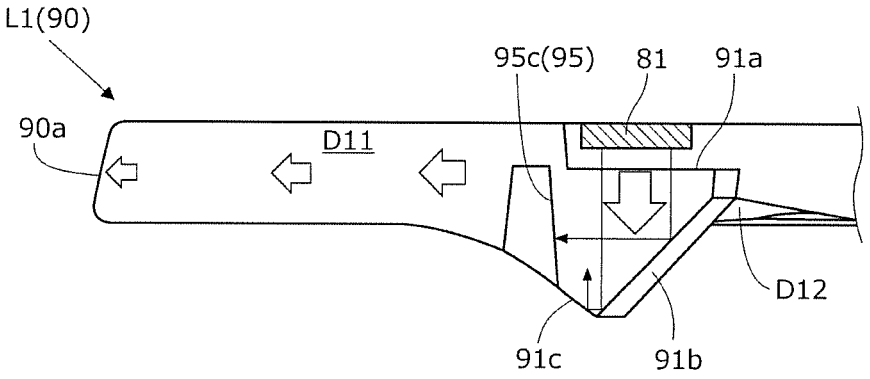
FIG. 9 is an enlarged cross-sectional schematic diagram taken along line D-D of a first light guiding region provided in the light guide body in FIG. 6.

FIG. 9 is an enlarged cross-sectional schematic diagram taken along line D-D of a first light guiding region L1 in FIG. 6.

FIG. 9 also illustrates the LED 81. Each of the solid line arrows in FIG. 9 schematically illustrates a path which light from the LED 81 is guided (hereinafter, the same applies to FIG. 10 to FIG. 12). Each of the void arrows in FIG. 9 schematically illustrates a quantity of light (intensity) of guided light with the size of the arrow (hereinafter, the same applies to FIG. 10 to FIG. 12).

A part in the top surface of the projecting part 91 that is adjacent to the central hole 90*h*1 (see FIG. 6) is concave towards the downside. The concave part (surface) is the incident surface 91*a*. The incident surface 91*a* is a surface on which light from the LED 81 (see FIG. 6) is incident. Light incident on the incident surface 91*a* is guided within light guide body 90. The incident surface 91*a* is parallel to the top surface of the projecting part 91. The incident surface 91*a* is disposed between the groove 95 and the central hole 90*h*1 in a bottom view (or in a plan view).

A part in the undersurface of the projecting part 91 that is adjacent to the central hole 90*h*1 (a part opposing the incident surface 91*a*) is inclined toward the outer peripheral edge side of the light guide body 90 and the downside. The inclined part (surface) is a first reflecting surface 91*b*. That is, the first reflecting surface 91*b* is disposed on the downside of the incident surface 91*a*, being inclined against the incident surface 91*a*. The first reflecting surface 91*b* is a surface that reflects light incident on the light guide body 90 from the incident surface 91*a* toward the radially outside (groove 95 side) of the light guide body 90.

A part in the undersurface of the projecting part 91 that is on the outer peripheral edge side of the light guide body 90 rather than the first reflecting surface 91*b*, is inclined toward the outer peripheral edge side of the light guide body 90 and the upside. The inclined part is a second reflecting surface 91*c*. The second reflecting surface 91*c* is a surface for partially reflecting light from the first reflecting surface 91*b*.

The configurations of the projecting parts 92-94 are in common with the configuration of the projecting part 91. More specifically, as illustrated in FIG. 5 to FIG. 8, the light guide body 90 includes incident surfaces 91*a*, 92*a*, 93*a* and 94*a*, first reflecting surfaces 91*b*, 92*b*, 93*b* and 94*b*, and second reflecting surfaces 91*c*, 92*c*, 93*c* and 94*c*.

Referring now back to FIG. 6, the respective incident surfaces 91*a*-94*a* (see FIG. 5) are disposed at intervals of an equal angle (90° in the present embodiment) in a circumferential direction of the light guide body 90. The respective first reflecting surfaces 91*b*-94*b* are disposed at intervals of an equal angle (90° in the present embodiment) in the circumferential direction of the light guide body 90. The respective second reflecting surfaces 91*c*-94*c* are disposed at intervals of an equal angle (90° in the present embodiment) in the circumferential direction of the light guide body 90. In other words, the respective incident surfaces 91*a*-94*a*, the respective first reflecting surfaces 91*b*-94*b*, and the respective second reflecting surfaces 91*c*-94*c* are respectively disposed at intervals of an equal angle (90° in the present embodiment) on a concentric circle of the outer peripheral surface 90*a* of the light guide body 90, in a bottom view (or in a plan view).

The projecting part 91 covers the LED 81 in an eave shape from the downside. The projecting part 92 covers the LED 82 in an eave shape from the downside. The projecting part 93 covers the LED 83 in an eave shape from the downside. The projecting part 94 covers the LED 84 in an eave shape from the downside (see also FIG. 5, FIG. 8, and FIG. 9). As a result, the incident surface 91*a* opposes the LED 81. The incident surface 92*a* opposes the LED 82. The incident surface 93*a* opposes the LED 83. The incident surface 94*a* opposes the LED 84. Thus, the incident surfaces 91*a*-94*a* are arranged for each of the LEDs 81-84.

The respective grooves 95-98 form parts of respective light guiding paths L11-L42, which will be described below, together with the respective sub-holes 90*h*2-90*h*5. The respective grooves 95-98 are flat in substantially V-shapes, in a bottom view. The respective grooves 95-98 are disposed on the undersurface of the light guide body 90. The respective grooves 95-98 are disposed at intervals of an equal angle (90° in the present embodiment) in the circumferential direction of the light guide body 90, between the central hole 90*h*1 and the sub-holes 90*h*2-90*h*5, and the outer peripheral surface 90*a* of the light guide body 90.

Bottom surfaces of the respective grooves 95-98 are parallel to the top surface of the light guide body 90. The bottom surfaces of the respective grooves 95-98 are positioned above the incident surfaces 91*a*-94*a* corresponding to the respective grooves 95-98 (see FIG. 8 and FIG. 9), in the vertical direction (the thickness direction of the light guide body 90).

The groove 95 includes a first groove part 95*a*, a second groove part 95*b*, and a coupling part 95*c* that couples the first groove part 95*a* and the second groove part 95*b*.

The first groove part 95*a* is disposed between the sub-hole 90*h*2 and the outer peripheral surface 90*a* of the light guide body 90. The first groove part 95*a* is in an arc shape along the inner peripheral surface 90*h*2*a* corresponding to the sub-hole 90*h*2, in the inner peripheral surface of the light guide body 90, in a bottom view. The direction along the inner peripheral surface 90*h*2*a* is a first direction in the present direction regarding the groove 95. The width of the first groove part 95*a* is gradually narrowed from an end closest to the coupling part 95*c* toward an end (a tip part) farthest from the coupling part 95*c* in the first groove part 95*a*. A tip part (the end on the side farther from the coupling part 95*c*) of the first groove part 95*a* is in a semicircular shape, in a bottom view.

The second groove part 95*b* is disposed between the sub-hole 90*h*3 and the outer peripheral surface 90*a* of the light guide body 90. The second groove part 95*b* is in an arc shape along the inner peripheral surface 90*h*3*a* corresponding to the sub-hole 90*h*3, in the inner peripheral surface of the light guide body 90, in a bottom view. The direction along the inner peripheral surface 90*h*3*a* is a second direction in the present invention regarding the groove 95. The width of the second groove part 95*b* is gradually narrowed from the end closest to the coupling part 95*c* toward the end (a tip part) farthest from the coupling part 95*c* in the second groove part 95*b*. A tip part (the end on the side farther from the coupling part 95*c*) of the second groove part 95*b* is in a semicircular shape, in a bottom view.

The coupling part 95*c* is disposed on the second reflecting surface 91*c*. In other words, the coupling part 95*c* is disposed between the central hole 90*h*1 and the outer peripheral surface 90*a* of the light guide body 90. The side surface of the coupling part 95*c* on the central hole 90*h*1 side is in a semicircular shape, in a bottom view.

As described above, the coupling part 95*c* is disposed on the second reflecting surface 91*c*. Thus, the groove 95 is configured to maximize the depth of the groove 95 in the coupling part 95*c*. In other words, the groove 95 is configured to maximize the depth of the groove 95 in a part in the groove 95 closest to the LED 81. In this regard, the "depth" refers to a length (distance) along the vertical direction from the bottom surface of the groove 95 to the undersurface of the light guide body 90 contacting the groove 95.

It should be noted that the coupling part may be disposed in a region outer than the second reflecting surface in a radial direction of the light guide body, i.e., a region in which the top surface and the undersurface of the light guide body are parallel to each other. In this case, the depth of the coupling part is the same as each of the depths of the first groove part and the second groove part. That is, the depth of the groove in this case is constant in the entire groove.

The coupling part 95*c* is arranged along with the LED 81 and the incident surface 91*a* on a radial line of the light guide body 90, in a bottom view. That is, in the groove 95, the coupling part 95*c* is disposed closest to the LED 81. In other words, in the groove 95, the coupling part 95*c* is the part closest to the LED 81. The first groove part 95*a* is disposed at a position symmetrical to the second groove part 95*b*, with respect to the radial line. The shape of the first groove part 95*a* is symmetrical to the shape of the second groove part 95*b*, with respect to the radial line.

The distance between the first groove part 95*a* and the outer peripheral surface 90*a* is gradually shortened from an end closest to the LED 81 toward an end (a tip end) farthest from the LED 81 in the first groove part 95*a*. The distance between the first groove part 95*b* and the outer peripheral surface 90*a* is gradually shortened from an end closest to the LED 81 toward an end (a tip end) farthest from the LED 81 in the first groove part 95*b*. That is, the groove 95 is configured to maximize the distance between a part in the groove 95 (coupling part 95*c*) closest to the LED 81 and the outer peripheral surface 90*a*. The distance between the groove 95 and the outer peripheral surface 90*a* is gradually shortened from the part closest to the LED 81 toward the part farthest from the LED 81 in the groove 95.

Each of the widths of the first groove part 95*a* and the second groove part 95*b* is gradually narrowed from the part closest to the coupling part 95*c* toward the part farthest from the coupling part 95*c* in the groove 95. In other words, the groove 95 is configured to maximize each of the widths of the first groove part 95*a* and the second groove part 95*b* in the part in the groove 95 closest to the LED 81. Each of the widths of the first groove part 95*a* and the second groove part 95*b* is gradually narrowed from the part closest to the LED 81 toward the part farthest from the LED 81 in the groove 95.

The configurations of the grooves 96-98 are in common with the configuration of the groove 95. More specifically, the groove 96 includes a first groove part 96*a*, a second groove part 96*b*, and a coupling part 96*c*. The groove 97 includes a first groove part 97*a*, a second groove part 97*b*, and a coupling part 97*c*. The groove 98 includes a first groove part 98*a*, a second groove part 98*b*, and a coupling part 98*c*. A positional relation between the LED 81 and the groove 95 is in common with each of positional relations between the LED 82 and the groove 96, between the LED 83 and the groove 97, and between the LED 84 and the groove 98. In other words, the respective grooves 95-98 are arranged for each of the incident surfaces 91*a*-94*a* corresponding to the LEDs 81-84.

In the light guide body 90, a part partitioned by the straight line (dashed line in FIG. 6) connecting a center point of the central hole 90*h*1 and a center point of the sub-hole 90*h*2, and the straight line (dashed line in FIG. 6) connecting the center point of the central hole 90*h*1 and a center point of the sub-hole 90*h*3, in a bottom view, defines a first light guiding region L1.

The first light guiding region L1 is a region that guides light from the LED 81 toward the outer peripheral surface 90*a*. The first light guiding region L1 includes a first light guiding path L11, a second light guiding path L12, a first diffusion path D11, a second diffusion path D12, and a third diffusion path D13.

The first light guiding path L11 guides light from the LED 81 toward the first diffusion path D11 and the second diffusion path D12. The first light guiding path L11 is a substantially arc-shaped region between the first groove part 95*a* and the sub-hole 90*h*2, in the light guide body 90, in a bottom view.

In the first light guiding path L11, a side surface 95*a*1 on the sub-hole 90*h*2 side of the first groove part 95*a* at least partially functions as a reflecting surface that reflects light incident on the incident surface 91*a*. That is, the groove 95 has the side surface 95*a*1 that at least partially functions as a reflecting surface. The reflecting surface is constituted by a part of the side surface 95*a*1 of the groove 95. In other words, the groove 95 includes the reflecting surface that reflects light incident on the incident surface 91*a*.

In the first light guiding path L11, on the inner peripheral surface of the light guide body 90, the inner peripheral surface 90*h*2*a* corresponding to the sub-hole 90*h*2 at least partially functions as a re-reflecting surface that reflects light reflected by the reflecting surface (side surface 95*a*1). That is, a part of the inner peripheral surface 90*h*2*a* at least partially functions as a re-reflecting surface. In other words, the re-reflecting surface is constituted by a part of the inner peripheral surface 90*h*2*a* of the sub-hole 90*h*2. That is to say, the light guide body 90 includes the inner peripheral surface 90*h*2*a* that functions as the re-reflecting surface.

The second light guiding path L12 guides light from the LED 81 toward the first diffusion path D11 and the third diffusion path D13. The second light guiding path L12 is an arc-shaped region between the second groove part 95*b* and the sub-hole 90*h*3, in a bottom view.

In the second light guiding path L12, a side surface 95*b*1 on the sub-hole 90*h*3 side of the second groove part 95*b* at least partially functions as a reflecting surface that reflects light incident on the incident surface 91*a*. That is, the groove 95 has the side surface 95*b*1 that at least partially functions as a reflecting surface (the groove 95 includes a reflecting surface). The reflecting surface is constituted by a part of the side surface 95*b*1 of the groove 95.

In the second light guiding path L12, on the inner peripheral surface of the light guide body 90, the inner peripheral surface 90*h*3*a* corresponding to the sub-hole 90*h*3 at least partially functions as a re-reflecting surface that reflects light reflected by the reflecting surface (side surface 95*b*1). That is, a part of the inner peripheral surface 90*h*3*a* at least partially functions as a re-reflecting surface. In other words, the re-reflecting surface is constituted by a part of the inner peripheral surface 90*h*3*a* of the sub-hole 90*h*3. That is to say, the light guide body 90 includes the inner peripheral surface 90*h*3*a*, which functions as the re-reflecting surface.

The first diffusion path D11 guides light guided from the first light guiding path L11 and the second light guiding path L12 to the outer peripheral surface 90*a* of the light guide body 90, while diffusing light, and substantially uniformly radiates light from the outer peripheral surface 90*a*. The first diffusion path D11 is a substantially fan-shaped region between the groove 95 and the outer peripheral surface 90*a*, in a bottom view.

The second diffusion path D12 guides light guided from the first light guiding path L11 to the outer peripheral surface 90*a* of the light guide body 90, while diffusing light, and substantially uniformly radiates light from the outer peripheral surface 90*a*. The second diffusion path D12 is an arc-shaped region between the sub-hole 90*h*2 and the outer peripheral surface 90*a*, in a bottom view. The undersurface of the second diffusion path D12 is an inclined surface that is inclined toward the inner peripheral edge side of the light guide body 90 and the upside, excluding the outer peripheral edge part (the portion on the outer peripheral surface 90*a* side) (see FIG. 5).

The third diffusion path D13 guides light guided from the second light guiding path L12 to the outer peripheral surface 90*a*, while diffusing light, and substantially uniformly radiates light from the outer peripheral surface 90*a*. The third diffusion path D13 is an arc-shaped region between the sub-hole 90*h*3 and the outer peripheral surface 90*a*, in a bottom view. The undersurface of the third diffusion path D13 is an inclined surface that is inclined toward the inner peripheral edge side of the light guide body 90 and the upside, excluding the outer peripheral edge part (see FIG. 5).

In the first light guiding region L1, each of the top surface and the undersurface of the light guide body 90 functions as a reflecting surface that reflects light. More specifically, for example, light guided to the first light guiding path L11 is also reflected by the top surface and the undersurface of the light guide body 90, and guided to the second diffusion path D12.

In the light guide body 90, a part that is partitioned by the straight line (dashed line in FIG. 6) connecting the center point of the central hole 90*h*1 and the center point of the sub-hole 90*h*3, and the straight line (dashed line in FIG. 6) connecting the center point of the central hole 90*h*1 and the center point of the sub-hole 90*h*4, in a bottom view, defines a second light guiding region L2. The configuration and the shape of the second light guiding region L2 are in common with the configuration and the shape of the first light guiding region L1. More specifically, the second light guiding region L2 includes a first light guiding path L21, a second light guiding path L22, a first diffusion path D21, a second diffusion path D22, and a third diffusion path D23. The second diffusion path D22 is connected with the third diffusion path D13 of the first light guiding region L1.

In the light guide body 90, a part that is partitioned by the straight line (dashed line in FIG. 6) connecting the center point of the central hole 90*h*1 and the center point of the sub-hole 90*h*4, and the straight line (dashed line in FIG. 6) connecting the center point of the central hole 90*h*1 and the center point of the sub-hole 90*h*5, in a bottom view, defines a third light guiding region L3. The configuration and the shape of the third light guiding region L3 are in common with the configuration and the shape of the first light guiding region L1. More specifically, the third light guiding region L3 includes a first light guiding path L31, a second light guiding path L32, a first diffusion path D31, a second diffusion path D32, and a third diffusion path D33. The second diffusion path D32 is connected with the third diffusion path D23 of the second light guiding region L2.

In the light guide body 90, a part that is partitioned by the straight line (dashed line in FIG. 6) connecting the center point of the central hole 90*h*1 and the center point of the sub-hole 90*h*5, and the straight line (dashed line in FIG. 6) connecting the center point of the central hole 90*h*1 and the center point of the sub-hole 90*h*2, in a bottom view, defines a fourth light guiding region L4. The configuration and the shape of the fourth light guiding region L4 are in common with the configuration and the shape of the first light guiding region L1. More specifically, the fourth light guiding region L4 includes a first light guiding path L41, a second light guiding path L42, a first diffusion path D41, a second diffusion path D42, and a third diffusion path D43. The second diffusion path D42 is connected with the third diffusion path D33 of the third light guiding region L3. The third diffusion path D43 is connected with the second diffusion path D12 of the first light guiding region L1.

Referring now back to FIG. 3, the male screw part 60*a* is disposed in the sub-hole 90*h*2, the male screw part 60*b* is disposed in the sub-hole 90*h*3, the male screw part 60*c* is disposed in the sub-hole 90*h*4, and the male screw part 60*d* is disposed in the sub-hole 90*h*5.

Operation of Light Guide Body for a Microphone

Referring now back to FIG. 6, the light guide body 90 guides light from the LEDs 81-84 to the outer peripheral surface 90*a* by using the first light guiding region L1, the second light guiding region L2, the third light guiding region L3, and the fourth light guiding region L4, and substantially uniformly radiates light from this outer peripheral surface 90*a*. The operation of each of the first light guiding region L1, the second light guiding region L2, the third light guiding region L3, and the fourth light guiding region L4 is in common with one another, except for the point where the LEDs 81-84 to be used as the light sources are different from one another. Accordingly, the operation of the light guide body 90 will be described below referring to FIG. 9, by using the operation of the first light guiding region L1 as an example.

Figure 10:
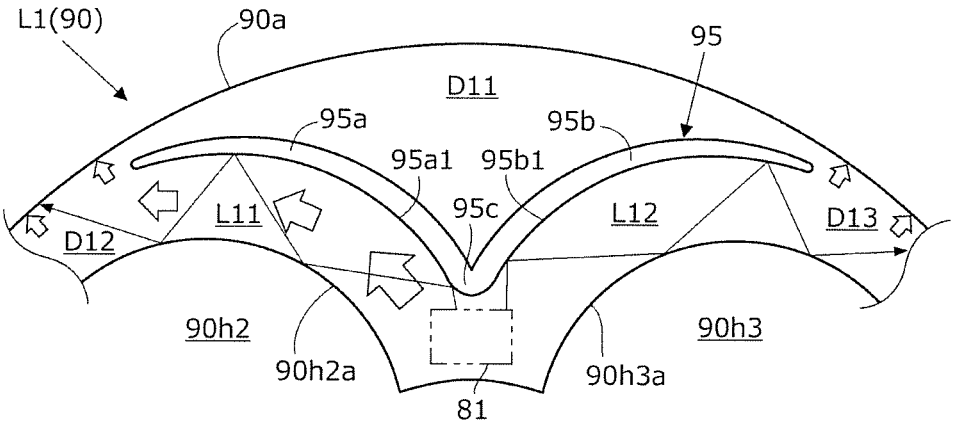
FIG. 10 is an enlarged cross-sectional schematic diagram taken along line E-E in FIG. 8 of the first light guiding region in FIG. 9.

FIG. 10 is an enlarged cross-sectional schematic diagram taken along line E-E in FIG. 8 of the first light guiding region L1 in FIG. 9.

The two-dot chain line in this figure illustrates the LED 81. This figure schematically illustrates how light from the LED 81 is guided within the first light guiding path L11 and the second light guiding path L12.

Light from the LED 81 is incident into the inside of the first light guiding region L1 (light guide body 90) from the incident surface 91*a*. Light incident on the incident surface 91*a* (see FIG. 9) is then reflected by the first reflecting surface 91*b* (see FIG. 9) and a part of the second reflecting surface 91*c* (see FIG. 9), and is guided toward the first groove part 95*a* (first light guiding path L11), the second groove part 95*b* (second light guiding path L12), and the coupling part 95*c*. As described above, the bottom surface of the groove 95 is then positioned above the incident surface 91*a*, in the vertical direction. Thus, light incident from the incident surface 91*a* does not directly travel to the first diffusion path D11 from between the bottom surface of the groove 95 and the top surface of the light guide body 90, but is guided toward the groove 95.

In the first light guiding path L11, light traveling to the first groove part 95*a* is partially reflected by the side surface (reflecting surface) 95*a*1 of the first groove part 95*a*, and is guided toward the sub-hole 90*h*2. That is, the side surface (reflecting surface) 95*a*1 reflects light incident on the incident surface 91*a* toward the sub-hole 90*h*2.

In the first light guiding path L11, light guided to the sub-hole 90*h*2 is partially reflected by the inner peripheral surface (re-reflecting surface) 90*h*2*a*, and is guided toward the first groove part 95*a* and the second diffusion path D12.

In the second light guiding path L12, light traveling to the second groove part 95*b* is partially reflected by the side surface (reflecting surface) 95*b*1 of the second groove part 95*b*, and is guided toward the sub-hole 90*h*3. That is, the side surface (reflecting surface) 95*b*1 reflects light incident on the incident surface 91*a* toward the sub-hole 90*h*3.

In the second light guiding path L12, light guided to the sub-hole 90*h*3 is partially reflected by the inner peripheral surface (re-reflecting surface) 90*h*3*a*, and is guided toward the second groove part 95*b* and the third diffusion path D13.

Light guided to the coupling part 95*c* is partially reflected by the side surface of the coupling part 95*c*, and is guided toward the first light guiding path L11 and the second light guiding path L12. Light guided to the first light guiding path L11 is guided to the second diffusion path D12 while being reflected by the side surface (reflecting surface) 95*a*1 of the first groove part 95*a* and the inner peripheral surface (re-reflecting surface) 90*h*2*a*. On the other hand, light guided to the second light guiding path L12 is guided to the third diffusion path D13 while being reflected by the side surface (reflecting surface) 95*b*1 of the second groove part 95*b* and the inner peripheral surface (re-reflecting surface) 90*h*3*a*. In other words, light incident on the incident surface 91*a* is guided to the first groove part 95*a* and the second groove part 95*b* through the coupling part 95*c*.

In this manner, light guided to the first light guiding path L11 is guided to the second diffusion path D12 while being reflected by the side surface (reflecting surface) 95*a*1 of the first groove part 95*a* and the inner peripheral surface (re-reflecting surface) 90*h*2*a*. A quantity of light of light guided to the first light guiding path L11 then attenuates as light becomes farther from the LED 81, due to an influence, for example, of internal loss by light diffusion within the first light guiding path L11 and of radiation from the first light guiding path L11.

Similarly, light guided to the second light guiding path L12 is guided to the third diffusion path D13 while being reflected by the side surface (reflecting surface) 95*b*1 of the second groove part 95*b* and the inner peripheral surface (re-reflecting surface) 90*h*3*a*. A quantity of light of light guided to the second light guiding path L12 then attenuates as light becomes farther from the LED 81 due to an influence, for example, of internal loss by light diffusion within the second light guiding path L12 and of radiation from the second light guiding path L12.

Light guided to each of the second diffusion path D12 and the third diffusion path D13 is diffused in the inside of each of the second diffusion path D12 and the third diffusion path D13, and is radiated from the outer peripheral surface 90*a*. In this regard, as described above, each undersurface of the second diffusion path D12 and the third diffusion path D13 is an inclined surface that is inclined toward the inner peripheral edge side of the light guide body 90 and the upside. Thus, light guided to each of the second diffusion path D12 and the third diffusion path D13 is likely to be guided toward the outer peripheral surface 90*a* by this inclined surface.

Light guided to the second diffusion path D12 is partially guided also to the third diffusion path D43 of the fourth light guiding region L4, which is connected with the second diffusion path D12, in addition to the outer peripheral surface 90*a*. Similarly, light guided to the third diffusion path D13 is also partially guided to the second diffusion path D22 of the second light guiding region L2, which is connected with the third diffusion path D13, in addition to the outer peripheral surface 90*a*.

In this regard, light guided to the first light guiding path L11 is partially transmitted through the side surface (reflecting surface) 95*a*1 of the first groove part 95*a*, and is incident on the first diffusion path D11 from the first groove part 95*a*. In addition, light guided to the second light guiding path L12 is partially transmitted through the side surface (reflecting surface) 95*b*1 of the second groove part 95*b*, and is incident on the first diffusion path D11 from the second groove part 95*b*.

Figure 11:
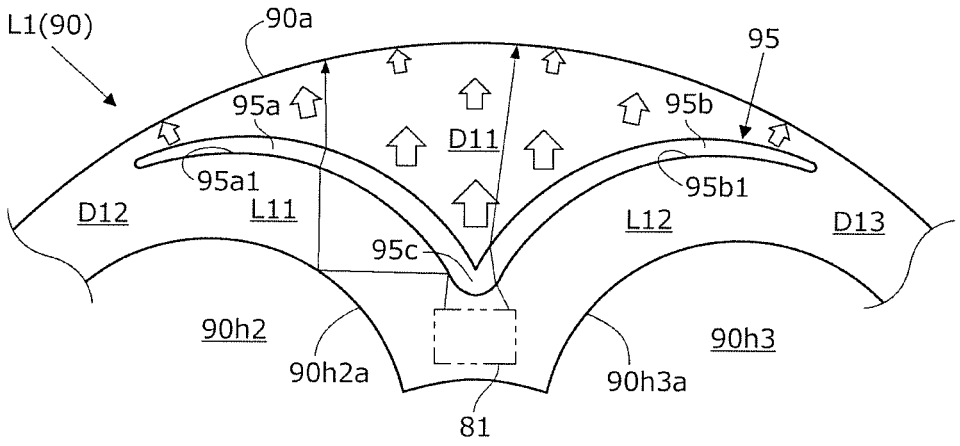
FIG. 11 is another enlarged cross-sectional schematic diagram taken along line E-E in FIG. 8 of the first light guiding region in FIG. 9.

FIG. 11 is another enlarged cross-sectional schematic diagram taken along line E-E in FIG. 8 of the first light guiding region L1 in FIG. 9.

The two-dot chain line in this figure illustrates the LED 81. This figure schematically illustrates how light from the LED 81 is partially transmitted through the reflecting surface (side surfaces 95*a*1, 95*b*1), and is guided within the first diffusion path D11.

Light incident on (guided into) the first diffusion path D11 from the groove 95 is diffused within the first diffusion path D11, and is radiated from the outer peripheral surface 90*a*. A quantity of light of light guided within the first diffusion path D11 becomes the strongest in a vicinity of the coupling part 95*c*, and attenuates as light becomes farther from the coupling part 95*c* due to an influence, for example, of internal loss by light diffusion within the first diffusion path D11 and of radiation from the first diffusion path D11.

In this regard, the groove 95 is a region that reflects and transmits light, and it does not emit light. Accordingly, the groove 95 when viewed from the outer peripheral surface 90*a* generally appears as a dark shadow on the outer peripheral surface 90*a*, in a side (the radial direction of the light guide body 90) view. The darkness of the shadow of the groove 95 depends on the width of the groove 95 and the distance between the groove 95 and the outer peripheral surface 90*a*. More specifically, the darkness of the shadow of the groove 95 becomes darker as the width of the groove 95 becomes wider, and becomes darker as the distance between the groove 95 and the outer peripheral surface 90*a* becomes shorter. In addition, the darkness of the shadow of the groove 95 becomes darker as the depth of the groove 95 becomes deeper.

As described above, the width of the groove 95 is gradually narrowed from the part closest to the LED 81, which is the light source, toward the part farthest to the LED 81 in the groove 95. In addition, the distance between the groove 95 and the outer peripheral surface 90*a* is gradually shortened from the part closest to the LED 81 toward the part farthest to the LED 81 in the groove 95. Thus, the darkness of the shadow of the groove 95 is adjusted by the shape and the arrangement of the groove 95 so as to become substantially uniform on the entire outer peripheral surface 90*a* in accordance with the quantity of light of light guided within the first diffusion path D11. More specifically, the quantity of light of light guided by the first diffusion path D11 and radiated from the outer peripheral surface 90*a* is adjusted by the shape and the arrangement of the groove 95 with respect to the LED 81, which is the light source. In other words, the shapes and the arrangements of the grooves 95-98 in the present invention are adjusted such that quantity of light of light guided to the first diffusion paths D11-D41 and radiated from the outer peripheral surface 90*a* become uniform, and become substantially equal to quantity of light of light guided to each of the second diffusion paths D12-D42 and to each of the third diffusion paths D13-D43 and radiated from the outer peripheral surface 90*a*.

Figure 12:
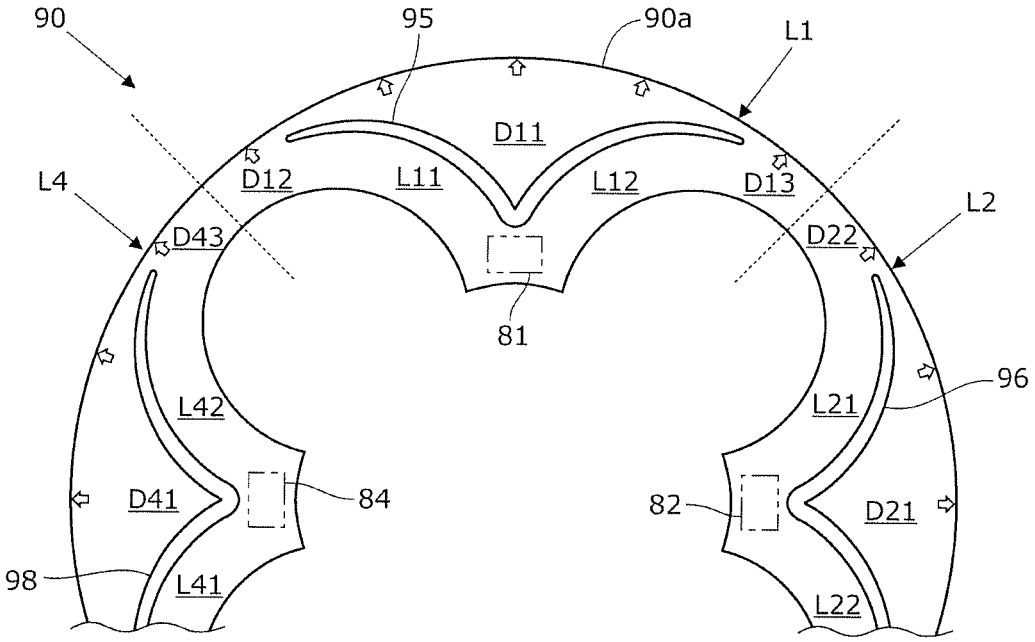
FIG. 12 is a schematic diagram illustrating a quantity of light of light guided by the light guide body in FIG. 6.

FIG. 12 is a schematic diagram illustrating the quantity of light of light guided by the first light guiding region L1, the second light guiding region L2, and the fourth light guiding region L4.

This figure illustrates that the quantity of light of light guided to the respective light guiding regions L1, L2 and L4, and radiated from the outer peripheral surface 90*a*, are substantially uniform by being adjusted by the grooves 95, 96 and 98.

In this manner, the respective light guiding paths L11, L12, L21, L22, L31, L32, L41 and L42 corresponding to the respective LEDs 81-84 are formed by the grooves 95-98 corresponding to the respective LEDs 81-84 and the sub-holes 90*h*1-90*h*4. The light guide body 90 radiates light, which is from the respective LEDs 81-84, from the outer peripheral surface 90*a* with a substantially uniform quantity of light. In other words, the light guide body 90 adjusts the quantity of light of light guided to the outer peripheral surface 90*a* from the respective first diffusion paths D11-D41, by the shapes and the arrangements of the grooves 95-98 corresponding to the respective LEDs 81-84. As a result, the light guide body 90 can radiate light, which is from the respective LEDs 81-84, from the entire outer peripheral surface 90*a* with a substantially uniform quantity of light.

Operation of Microphone

When the microphone 1 is powered on by a user of the microphone 1, the LEDs 81-84 emit light of (are lighted in) red color. Light from the LEDs 81-84 are guided by the light guide body 90, and radiated from the outer peripheral surface 90*a* to the exterior of the microphone 1, with a substantially uniform quantity of light.

Figure 13:
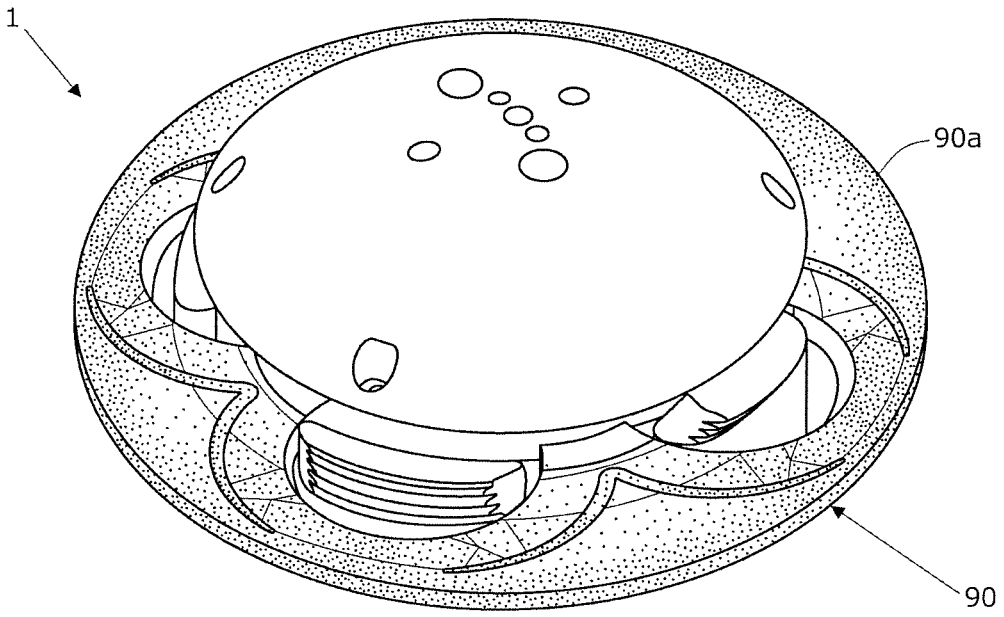
FIG. 13 is a schematic diagram illustrating an exemplary operation of the microphone in FIG. 1.

FIG. 13 is a schematic diagram illustrating an example of the operation of the microphone 1.

This figure illustrates a state which the light guide body 90 guides light from the light-emitting part 80 (not illustrated in FIG. 13), when the head case 10, the unit support member 40, and the unit part 50 are removed. For convenience of explanation, this figure is illustrated upside down to the page. This figure illustrates the brightness of the light guide body 90 with the number of black dots. More specifically, this figure illustrates darker regions with an increasing number of black dots, and illustrates brighter regions with a decreasing number of black dots. That is, this figure illustrates that the light guide body 90 radiates light, which is from the light-emitting part 80, with a substantially uniform quantity of light from the outer peripheral surface 90*a*.

CONCLUSION

According to the embodiment described above, the light guide body 90 has a plate shape, and includes the incident surfaces 91*a*-94*a* and the grooves 95-98. Light from the light-emitting part 80 that are incident from the incident surfaces 91*a*-94*a* is reflected by the side surfaces 95*a*1-98*a*1, 95*b*1-98*b*1 (see FIG. 6) of the grooves 95-98, which are the reflecting surfaces, and are guided within the light guide body 90. In this manner, the side surfaces 95*a*1-98*a*1, 95*b*1-98*b*1 of the grooves 95-98 at least partially function as the reflecting surfaces. Thus, by adjusting the shapes and the arrangements of the grooves 95-98, the light guide body 90 can radiate light from a small number of light sources of the light-emitting part 80, with a substantially uniform quantity of light from the outer peripheral surface 90*a*.

In addition, the light guide body 90 includes the sub-holes 90*h*2-90*h*5, which form the inner peripheral surfaces 90*h*2*a*-90*h*5*a* at least partially functioning as the re-reflecting surfaces. The re-reflecting surfaces are constituted by parts of each of the inner peripheral surfaces 90*h*2*a*-90*h*5*a*. Thus, the light guide body 90 can guide light, which is from a small number of light sources of the light-emitting part 80, toward the outer peripheral surface 90*a* by adjusting the shapes and the arrangements of the sub-holes 90*h*2-90*h*5.

Furthermore, the grooves 95-98 are disposed along the inner peripheral surfaces 90*h*2*a*-90*h*5*a*. Thus, in the light guide body 90, the light guiding paths L11-L42 for guiding light, which is from the light-emitting part 80, toward the outer peripheral surface 90*a*, are formed by the respective grooves 95-98 and the inner peripheral surfaces 90*h*2*a*-90*h*5*a* corresponding to the respective grooves 95-98.

In addition, the grooves 95-98 are configured to maximize the distances between a part in each of the grooves 95-98 (coupling parts 95*c*-98*c*), which is closest to the light-emitting part 80, and the outer peripheral surface (radiation surface) 90*a*. Those distances are gradually shortened from a part closest to the light emitting part 80 toward a part farthest to the light emitting part 80 in the grooves 95-98. Thus, the distances of diffusion of light guided to the first diffusion paths D11-D41 become longer as the quantity of light of light increase. As a result, light transmitted through the side surfaces 95*a*1-98*a*1, 95*b*1-98*b*1 of the grooves 95-98 and guided to the first diffusion paths D11-D41 is diffused by the first diffusion paths D11-D41, and radiated from the outer peripheral surface 90*a* with a substantially uniform quantity of light.

In addition, the grooves 95-98 are configured to maximize the depths in the parts closest to the light-emitting part 80. Thus, almost all light incident on the light guide body 90 from the light-emitting part 80 are guided to the grooves 95-98. Accordingly, amount of light to be guided to the first diffusion paths D11-D41 and the outer peripheral surface 90*a* without being reflected by the grooves 95-98, is restricted. That is, on the outer peripheral surface 90*a*, a large amount of light to be guided to parts of the outer peripheral surface 90*a* that are close to the light-emitting part 80, is the light guided by the grooves 95-98. As a result, the quantity of light of light radiated from the parts in the outer peripheral surface 90*a* that are close to the light-emitting part 80 is substantially equal to the quantity of light of light radiated from other parts of the outer peripheral surface 90*a*.

In addition, the grooves 95-98 are configured to maximize the widths of the parts in the grooves 95-98 closest to the light-emitting part 80. These widths are gradually narrowed from the parts closest to the light-emitting part 80 toward the parts farthest to the light-emitting part 80 in the grooves 95-98. Thus, the darkness of the shadows of the grooves 95-98 when the light guide body 90 is viewed from the outer peripheral surface 90*a* side, is adjusted so as to be substantially uniform on the entire outer peripheral surface 90*a* in accordance with the quantity of light of light guided to the first diffusion paths D11-D41, by the shapes and the arrangements of the grooves 95-98. More specifically, the quantity of light of light guided by the first diffusion paths D11-D41 and radiated from the outer peripheral surface 90*a* can be adjusted by the shapes and the arrangements of the grooves 95-98 with respect to the LEDs 81-84, which are the light sources. As a result, the quantity of light of light radiated from the first diffusion paths D11-D41 to the outer peripheral surface 90*a* become substantially uniform.

In addition, the light guide body 90 is in a disc shape. Thus, in the light guide body 90, the grooves 95-98 and the sub-holes 90*h*2-90*h*5 can be disposed at intervals of an equal angle in the circumferential direction of the light guide body 90. As a result, the light guide body 90 can radially guide light from the radial inside of the light guide body 90 (center side of the light guide body 90) toward the outer peripheral surface 90*a*.

In addition, the hole that is constituted by the central hole 90*h*1 and the sub-holes 90*h*2-90*h*5 is disposed at the center of the light guide body 90, in a bottom view (plan view). The respective incident surfaces 91*a*-94*a* are arranged concentrically with the outer peripheral surface 90*a*, between the grooves 95-98 and the hole. Thus, the respective incident surfaces 91*a*-94*a* are physically separated from one another by the hole. As a result, light from the respective LEDs 81-84 is incident only on the incident surfaces 91*a*-94*a* corresponding to (opposing) the respective LEDs 81-84.

In addition, the light guide body 90 includes the incident surfaces 91*a*-94*a* that are positioned (disposed) to respectively receive light from the LEDs 81-84, and the grooves 95-98 that are positioned (disposed) to respectively reflect light incident on the incident surfaces 91*a*-94*a*. Thus, light from the respective LEDs 81-84 is guided to only the grooves 95-98 corresponding to each of LEDs 81-84. That is, the respective grooves 95-98 guide only light from the corresponding LEDs 81-84. In other words, the respective grooves 95-98 do not guide light incident from different (non-corresponding) incident surfaces 91*a*-94*a*. As a result, the quantity of light of light guided to the respective groove 95-98 become stable.

In addition, the grooves 95-98 include the first groove parts 95*a*-98*a*, the second groove parts 95*b*-98*b*, and the coupling parts 95*c*-98*c*. Light incident on the respective incident surfaces 91*a*-94*a* is guided to the first groove parts 95*a*-98*a* and the second groove parts 95*b*-98*b* through the coupling parts 95*c*-98*c*. That is, light incident on the respective incident surfaces 91*a*-94*a* is allotted (distributed) to the first groove parts 95*a*-98*a* and the second groove parts 95*b*-98*b* respectively, by the coupling parts 95*c*-98*c*. That is, the light guide body 90 can allot (distribute) light from the LEDs 81-84 to the first groove parts 95*a*-98*a* (first light guiding paths L11-L41) and the second groove parts 95*b*-98*b* (second light guiding paths L12-L42), in accordance with the arrangements and the shapes of the coupling parts 95*c*-98*c*.

In addition, the shapes of the first groove parts 95*a*-98*a* are symmetrical to the shapes of the second groove parts 95*b*-98*b* with respect to a radial line of the light guide body 90 (outer peripheral surface 90*a*). As a result, the light guide body 90 can uniformly allot light from the LEDs 81-84 to the first groove parts 95*a*-98*a* (first light guiding paths L11-L41) and the second groove parts 95*b*-98*b* (second light guiding paths L12-L42).

In this manner, the grooves 95-98 and the sub-holes 90*h*2-90*h*5 form the light guiding paths (the first light guiding paths L11-L41 and the second light guiding paths L12-L42) for the LEDs 81-84 respectively. As a result, the respective light guiding paths L11-L42 guide light from the LEDs 81-84 toward the outer peripheral surface 90*a*. In the light guide body 90, the side surfaces 95*a*1-98*a*1 and 95*b*1-98*b*1 of the grooves 95-98 function as the reflecting surfaces, and the inner peripheral surfaces 90*h*2*a*-90*h*5*a* of the light guide body 90 function as the re-reflecting surfaces. As a result, the light guide body according to the present invention can radiate light, which is from a small number of light sources of the light-emitting part 80, from the outer peripheral surface 90*a* with a uniform quantity of light by adjusting the shapes and the arrangements of each of the grooves 95-98 and the sub-holes 90*h*2-90*h*5, regardless of the size and the shape of the light guide body 90.

It should be noted that light-emitting part may be constituted by monochromatic light-emitting LEDs. In this case, for example, two LEDs are arranged for each place along the radial direction of the light guide body 90. By arranging a plurality of LEDs along the radial direction, light from LEDs is uniformly distributed to the first light guiding paths and the second light guiding paths.

In addition, the number of each of the incident surfaces and the grooves should be any plural number, and it is not limited to "4". More specifically, for example, the number of each of the incident surfaces and the grooves may be "2", "3", or "5". In this case, the number of the sub-holes or the LEDs is increased/decreased in accordance with the number of each of the incident surfaces and the grooves.

Furthermore, the sub-holes are not limited to circular shapes. More specifically, for example, the sub-holes may be in elliptical shapes, polygonal shapes, or rectangular shapes.

In addition, the light guide body is not limited to a disc shape as long as it is in a plate shape. More specifically, for example, the light guide body may be in an elliptical plate shape, a rectangular plate shape, or a polygonal plate shape.

In addition, the shapes of the first diffusion paths are not limited to fan shapes. More specifically, for example, the outer peripheral edge parts of the first diffusion paths do not have to be in arc shapes, and they may be substantially rhombus shapes in which the outer peripheral edge parts form corner parts.

In addition, the widths of the grooves may be uniform from the coupling parts to the tip parts.

In addition, the thickness of the light guide body may be thinner from the central part toward the outer peripheral surface. In this case, light from the LEDs is condensed as light travels to the outer peripheral surface from the incident surface.

In addition, the shapes of the coupling parts on the light source side, in a bottom view, are not limited to semicircular shapes. More specifically, for example, the shapes of the coupling parts on the light source side, in a bottom view, may be V-shapes. In this case, light guided to the coupling parts is efficiently distributed to the first light guiding paths and the second light guiding paths.

In addition, the second reflecting surface may be covered with, for example, a metal film or mirror coating. As described above, the coupling parts, which are parts closest to the light sources (LEDs) in the grooves, are disposed on the second reflecting surface. Thus, in a radial direction view of the light guide body, the lower end parts of the side surfaces of the coupling parts shine brightly. Light gives an influence on the quantity of light of light radiated from the outer peripheral surface. By covering the second reflecting surface, the influence of light on the quantity of light of light radiated from the outer peripheral surface is suppressed.

In addition, in the embodiment described above, the respective grooves 95-98 for each of the incident surfaces 91*a*-94*a* are disposed independently (by being separated) from one another. Alternatively, the grooves of each of the incident surfaces may communicate with each other, i.e., adjacent grooves may be connected to each other.

Figure 14:
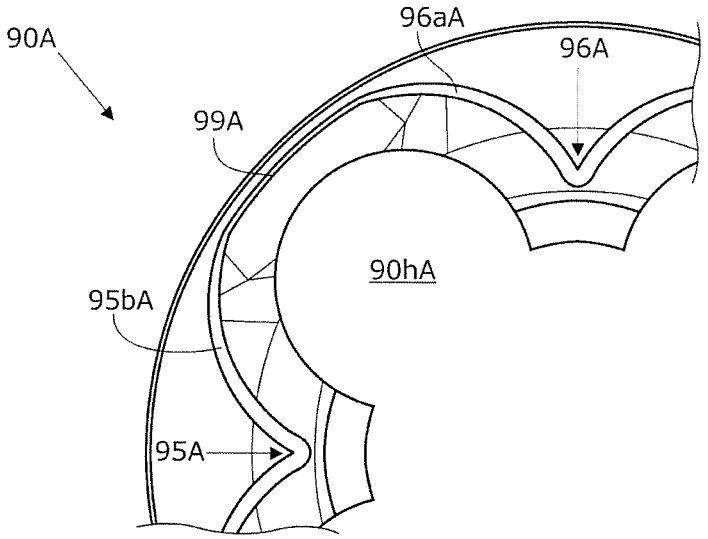
FIG. 14 is a schematic diagram illustrating another embodiment of a light guide body for a microphone according to the present invention.

FIG. 14 is a schematic diagram illustrating another embodiment of the present light guide body.

FIG. 14 illustrates that a light guide body 90A includes grooves 95A, 96A, and that a second groove part 95*b*A of the groove 95A and a first groove part 96*a*A of the groove 96A communicate with each other through a communication groove 99A. More specifically, this figure illustrates that the adjacent grooves 95A and 96A communicate with each other through the communication groove 99A. According to this configuration, the light guide body 90A forms C-shaped light guiding path, which guides light incident from both ends, with a sub-hole 90*h*A and a groove that is constituted by the second groove part 95*b*A, the communication groove 99A, and the first groove part 96*a*A. In other words, the light guide body 90A exerts an effect equivalent to provision of a plurality of conventional C-shaped light guide members, each of the C-shaped light guide members guides light incident from both ends of the light guide member.

In addition, in the embodiment described above, the shapes of each of the first groove parts 95*a*-98*a* and the second groove parts 95*b*-98*b* are arc shapes. Alternatively, the shapes of each of the first groove parts and the second groove parts may be polygonal shapes or linear shapes.

Figure 15:
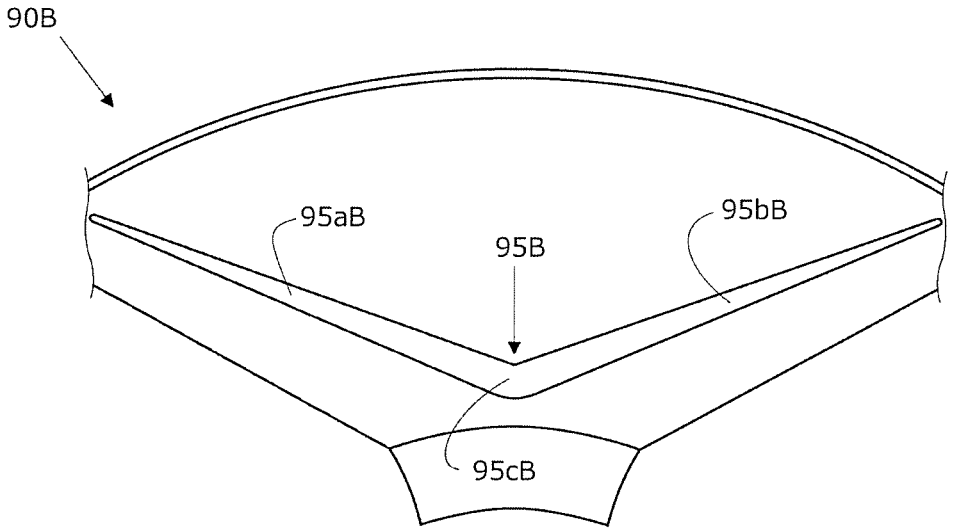
FIG. 15 is a schematic diagram illustrating still another embodiment of a light guide body for a microphone according to the present invention.

FIG. 15 is a schematic diagram illustrating still another embodiment of the present light guide body.

FIG. 15 illustrates that a light guide body 90B includes a groove 95B, and that a first groove part 95*a*B and a second groove part 95*b*B of the groove 95B linearly extend from a coupling part 95*c*B. According to this configuration, the light guide body 90B can extend tip parts of the groove 95B far away from the coupling part 95*c*B. As a result, for example, even if the light guide body is in a rectangular shape, light from a light-emitting part (not illustrated) is guided to corner parts of the light guide body.

The invention claimed is:

1. A light guide body for a microphone which indicates an operating state of the microphone to a surrounding of the microphone, wherein the light guide body guides light from one or more light sources which emit light in accordance with an operating state of a microphone unit of the microphone, wherein the light guide body has a plate shape, and wherein the light guide body comprises:

one or more incident surfaces on which light from the light source is incident; and one or more grooves, each of which includes a reflecting surface that reflects light incident on the incident surface, wherein at least one groove of the one or more grooves has a first side surface and a second side surface facing each other, wherein the first side surface at least partially functions as the reflecting surface.

2. The light guide body for the microphone according to claim 1, wherein the reflecting surface partially transmits light, and the light guide body further comprises:

a radiation surface that radiates light transmitted through the reflecting surface;

an inner peripheral surface that at least partially functions as a re-reflecting surface that reflects light reflected by the reflecting surface; and a hole that forms the inner peripheral surface, wherein the at least one groove is disposed between the radiation surface and the hole, and the reflecting surface reflects light incident on the incident surface toward the hole.

3. The light guide body for the microphone according to claim 2, wherein the at least one groove is disposed along the inner peripheral surface.

4. The light guide body for the microphone according to claim 2, wherein a distance between the at least one groove and the radiation surface is a maximum between a part in the at least one groove that is closest to the light source and the radiation surface.

5. The light guide body for the microphone according to claim 4, wherein the distance is gradually shortened from a part closest to the light source toward a part farthest to the light source in the at least one groove.

6. The light guide body for the microphone according to claim 2, wherein the at least one groove has a maximum depth in a part in the at least one groove that is closest to the light source.

7. The light guide body for the microphone according to claim 2, wherein the at least one groove has a maximum width in a part in the at least one groove that is closest to the light source.

8. The light guide body for the microphone according to claim 7, wherein the width is gradually narrowed from a part closest to the light source toward a part farthest to the light source in the at least one groove.

9. The light guide body for the microphone according to claim 2, wherein the light guide body has a disc shape, and the radiation surface is an outer peripheral surface of the light guide body.

10. The light guide body for the microphone according to claim 9, wherein the hole is disposed at a center in a plan view, and the incident surface is disposed between the at least one groove and the hole.

11. The light guide body for the microphone according to claim 9, wherein the one or more light sources comprise a plurality of the light sources, the one or more incident surfaces comprise a plurality of the incident surfaces, the one or more grooves include a plurality of the grooves, each of the incident surfaces corresponds to the respective light sources and is positioned to receive light from the corresponding light source, and each of the grooves corresponds to the respective light sources and is positioned to reflect light incident on the corresponding incident surface.

12. The light guide body for the microphone according to claim 11, wherein the incident surfaces are disposed at equal intervals on a concentric circle of the outer peripheral surface.

13. The light guide body for the microphone according to claim 11, wherein among the grooves for each of the incident surfaces, adjacent grooves communicate with each other.

14. The light guide body for the microphone according to claim 10, wherein the at least one groove comprises:

a first groove part that is disposed along a first direction;

a second groove part that is disposed along a second direction different from the first direction; and a coupling part that couples the first groove part and the second groove part, and wherein light incident on the incident surface is guided to the first groove part and the second groove part through the coupling part.

15. The light guide body for the microphone according to claim 14, wherein a shape of the first groove part is symmetrical to a shape of the second groove part, with respect to a radial line of the outer peripheral surface.

16. The light guide body for the microphone according to claim 2, further comprising a diffusion path that diffuses light transmitted through the reflecting surface, wherein the diffusion path is in a substantially fan shape in a bottom view, and the diffusion path is disposed between the radiation surface and the at least one groove.

17. A microphone, comprising:

a microphone unit;

a light source that emits light in accordance with an operating state of the microphone unit; and a light guide body on which light from the light source is incident to be guided to a radiation surface, wherein the light guide body has a plate shape, which comprises:

one or more incident surfaces on which light from the light source is incident; and one or more grooves, each of which includes a reflecting surface that reflects light incident on the incident surface, wherein at least one groove of the one or more grooves has a first side surface and a second side surface facing each other, wherein the first side surface at least partially functions as the reflecting surface.

18. The microphone according to claim 17, comprising a case that accommodates the microphone unit, wherein the radiation surface is exposed to an exterior of the case.

* * * * *